US006268594B1

(12) United States Patent
Leutner et al.

(10) Patent No.: US 6,268,594 B1
(45) Date of Patent: Jul. 31, 2001

(54) APPLIANCE SUCH AS A REFRIGERATOR OR FREEZER WITH A TRANSPARENT VIEWING DOOR AND A METHOD OF MANUFACTURE OF A REFRIGERATOR OR FREEZER WITH A TRANSPARENT VIEWING DOOR

(75) Inventors: Kurt Leutner; Sabine Melson, both of Mainz; Roland Leroux, Stadecken-Elsheim, all of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/405,863

(22) Filed: Sep. 24, 1999

(30) Foreign Application Priority Data

Sep. 25, 1998 (DE) ..... 198 44 046

(51) Int. Cl.[7] ..... H05B 3/06

(52) U.S. Cl. ..... 219/522; 219/205; 312/236; 52/171.2

(58) Field of Search ..... 219/200–205, 219/219, 522–548; 312/236; 52/171.2

(56) References Cited

U.S. PATENT DOCUMENTS 3,655,939 * 4/1972 Stromquist ..... 219/218
4,388,522 * 6/1983 Boaz ..... 219/522
4,453,669 * 6/1984 Karla et al. ..... 237/12.3 R
4,900,634 2/1990 Terneu et al. .
5,852,284 * 12/1998 Teder et al. ..... 219/522

FOREIGN PATENT DOCUMENTS 0712101 5/1996 (EP) .
0807611 11/1997 (EP) .
2033357 5/1980 (GB) .

* cited by examiner

*Primary Examiner*—Teresa Walberg
*Assistant Examiner*—Shauntina T. Fuqua
(74) *Attorney, Agent, or Firm*—Nils H. Ljungman & Associates

(57) ABSTRACT

A multipane insulating glass for appliances having an inner-chamber temperature which is lower than the ambient temperature, in particular for viewing doors of refrigerators and freezers comprises at least two panes which are of approximately equal size and are arranged at a distance from one another. The distance is maintained by a spacer which runs continuously around the vicinity of the edge. One of the two outer panes is provided with an electrically conductive, transparent coating on its side which faces towards the space between the panes. In this glass, the coating, which is applied to the entire surface, is deactivated in the peripheral area of the pane, containing the contact surface for the spacer. Also, a process for producing coated flat glass materials for such insulating glass materials, as described above.

20 Claims, 4 Drawing Sheets

APPLIANCE SUCH AS A REFRIGERATOR OR FREEZER WITH A TRANSPARENT VIEWING DOOR AND A METHOD OF MANUFACTURE OF A REFRIGERATOR OR FREEZER WITH A TRANSPARENT VIEWING DOOR

BACKGROUND OF THE INVENTION

1. Field of the Invention

The present invention relates to multipane insulating glass for appliances with an inner-chamber temperature which is lower than ambient temperature, in particular for viewing doors of refrigerators and freezers. The glass comprises at least two panes which are of approximately equal size and are arranged at a distance from one another, the distance being maintained by a spacer which runs continuously around the vicinity of the edge. One of the two outer panes is provided with an electrically conductive, transparent coating on its side which faces towards the space between the panes. The present invention furthermore relates to a process for producing coated flat glass materials for such insulating glass materials.

2. Background Information

In particular, upright and chest refrigerators and freezers have viewing doors with multipane insulating glass materials of the type described in the introduction. These materials delimit the cold area in the inner chamber from the higher ambient temperature.

In refrigerators, and in particular in freezers, the temperature difference between the inner chamber and the environment often results in the formation of condensation. The condensation from the atmospheric humidity which is precipitated on the pane makes it difficult or impossible to see the cooled articles in the inner chamber. In order to substantially prevent this, or in order for the precipitated condensation to be removed again quickly, in the appliances which are commercially available, the pane of the multipane insulating glass which faces towards the outside area is heated. This is achieved by means of a treatable, electrically conductive, transparent coating on the inside of the pane, i.e. on its side which faces towards the space between the panes. Such a coating consists, for example, of doped $SnO_2$ which is applied, for example, using a hot-spray process and is then fired.

To this end, before the coating operation, the pane of glass is cut to the desired size and a mask which covers the peripheral area is applied to the pane, so that the coating is kept off the subsequent contact surface for the spacer. This is necessary, despite the standard adhesive bonding using adhesives which are non-conductive in the cured state, in order to prevent the metal spacers used from causing spark-overs onto the spacers when the pane is heated, so that voltage is passing through the spacers, which may lead to overheating.

OBJECT OF THE INVENTION

Therefore, the object of the present invention is to provide multipane insulating glass which reduces the formation of condensation, can be produced with little process outlay and is electrically insulated reliably with respect to the outside.

SUMMARY OF THE INVENTION

The object can be achieved by means of multipane insulating glass which comprises at least two panes which are of approximately equal size and are arranged at a distance from one another. The distance is maintained by a spacer which runs continuously around the vicinity of the edge, and one of the two outer panes is provided with an electrically conductive, transparent coating on its side which faces towards the space between the panes. The conductive coating, which can be applied to the entire surface, is deactivated in the peripheral area of the pane, containing the contact surface for the spacer. The object can be further achieved by means of a process for producing coated flat glass materials for the production of multipane insulating glass materials including the steps of application of an electrically conductive, transparent coating to the entire surface of a flat glass pane, cutting the pane to size, and deactivation of the coating in the peripheral area of the pane, including the subsequent contact surface for the spacer.

In contradistinction to the treatable multipane insulating glass materials which have hitherto been known for appliances having an inner-chamber temperature which is lower than the ambient temperature, when flat glass materials for the production of the multipane insulating glass materials according to the invention are being produced, the electrically conductive, transparent coating is applied to the entire surface. It can be applied to the entire surface of commercially available flat glass which is only cut to the particular dimensions once it has been coated.

This eliminates the step of applying the mask prior to coating, which has hitherto been required. Also, it is not necessary to coat panes of numerous different, small formats.

The transparent coating, which can consist, for example, of doped tin oxide, e.g. with fluorine ($SnO_2$:F), is applied, for example, using the hot-spray process or the dip-coating process. Other coatings may be possible within the scope of the invention.

Such coated flat glass materials with sheet resistances of, for example, approx. 10 106 /□ (ohm/square) to 40 Ω/□ (ohm/square) are commercially available. Further suitable coating materials are, for example, silver or indium-tin oxide (ITO). It is advantageous for the coatings which are mentioned here by way of example to be not only electrically conductive but also heat-reflecting. Usually, such coatings are referred to, with reference to their scratch resistance, as hard coatings (with a high scratch resistance) and soft coatings (with a low scratch resistance).

For example, the doped tin oxide coatings are hard, and Ag layers and ITO layers represent soft coatings.

Panes with hard coatings are preferred in the context of the invention, since they are more suitable for thermal prestressing, and since multipane insulating glass materials usually comprise prestressed panes.

According to the invention, the electrically conductive, transparent coating, which was originally applied to the entire surface, can be deactivated, i.e. be made no longer electrically conductive, all the way around the peripheral area, specifically including the contact surface for the spacer. This allows commercially available spacers, for example made from metal, to be used in order to ensure the distance between the panes of the multipane insulating glass, without spark-overs onto the spacer when the pane is heated.

In addition to the deactivated direct contact surface for the spacer, the deactivated surface can extend at least another about 2 mm to about 3 mm, on both sides, beyond the contact surface for the spacer. Since the spacer does not directly adjoin the edge of the pane, but rather is slightly set back from the edge of the pane in the vicinity of this edge, in order to form a gap for insulating and sealing material, the deactivated surface preferably extends all the way to the edge of the pane, in order to increase the electrical safety.

In standard pane formats and with standard spacer sizes, the width of the deactivated zone is usually between about 5 mm and about 10 mm, and preferably between about 8 mm and about 10 mm.

Various processors are suitable for deactivation of the described partial area of the coating.

By way of example, soft coatings, e.g. silver coatings, can be removed by being ground off by means of a rotating grinding head tipped with, for example, corundum or diamond.

Such mechanical removal is not advantageous for hard coatings on glass, since it causes many panes to break.

To deactivate the coating, i.e. to remove its electrical conductivity, the coating does not necessarily have to be removed completely, but rather it is sufficient to destroy the coating in such a way that it is no longer electrically conductive.

This may be effected, for example, by the application of a glaze or of an enamel to that area of the coating which is to be deactivated and by subsequent heating of the pane. The glaze or the enamel can be fired in at temperatures which are below the deformation point of the glass of the pane, the vitreous composition of the glaze or of the enamel melting, penetrating into the coating and destroying its conductivity while being joined stably to the surface of the pane of glass.

Glazes customarily can comprise a transparent or translucent vitreous composition which is applied to the object in finely divided form, for example, in the form of a paste, using known techniques, such as, for example, screen printing, pad printing, transfer techniques or brush application. The finely ground glass powder is often also referred to as a glass frit. Enamels are glazes which contain coloring constituents, such as pigments. Since the color appearance is not important in this context, pigment free glazes are usually sufficient. Typical layer thicknesses are from about 5 mm to about 30 mm.

The glass frit should preferably have a lower melting point than the glass onto which it is fused. The firing temperatures therefore depend on the composition of both the glass frit and the glass pane. Typical firing temperatures and times on soda-lime glass materials are from about 650° C. to about 720° C. and from about 1 to about 10 minutes. The firing also serves to volatilize organic carrier materials which are used as auxiliaries for the application of the glaze or of the enamel. Preferably, the glaze is fired at the same time as the thermal prestressing process is carried out. As a result, the process outlay resulting from the additional process step of deactivating the coating is minimized. The process described is particularly preferred for the deactivation of hard coatings.

The process described for producing coated flat glass materials with a deactivated peripheral area, comprising the process steps of coating the entire surface, cutting to size and deactivation of the peripheral area, forms part of the production process for the multipane insulating glass, which can be finished in a customary way.

In the multipane insulating glass according to the present invention, the transparent, electrically conductive coating which, as described, is deactivated in partial areas and is situated on that side of one of the two outer panes which faces towards the space between the panes.

The spacer which runs continuously around the vicinity of the edge comes into contact with the coated pane in the area of the deactivated coating and is adhesively bonded to the panes in a customary way, for example using the butyl (polyisobutylene) which is customarily used in the manufacture of multipane insulating glass at present. The material is not electrically conductive. Standard polysulphide-based sealing materials, for example, are suitable as the sealing compound. The edge enclosure is also realized in a known way, for example by means of an adhesive tape, for example an insulating tape.

The cut edges are generally simply arrissed. In a particular embodiment of the invention, the edges of the coated pane are bevelled on the coated side. When making this bevel, the conductive coating is also milled off in this area. Such bevelled milling makes it easy to remove both soft and hard coatings.

The coated pane is heated by applying electricity to silver conductor tracks which have been applied. They are preferably applied by means of screen printing and are then dried. The current is supplied via insulated cables which are provided with cable lugs and are attached to a conductor track which has been printed on the coating. The cables are guided through the spacer in a known way.

Sufficient heating may be realized with very different sheet resistances. For example, if the voltage is suitably adapted, sheet resistances of between about 5 Ω/□ (ohm/square) and about 100 Ω/58 (ohm/square) are possible.

The power which is required for heating may be produced by voltages of between about 10 V and about 240 V, depending on the sheet resistance. Although a voltage which corresponds to the mains voltage has the advantage that a transformer is not required, it has the drawback that, if the pane breaks, parts which are under a voltage of, for example, 220 V or 230 V are accessible. Preference is given to voltages of between 12 V and 48 V, since in this case there is substantially no potential danger even in the event of defects in the insulating glass.

Naturally, the pane thickness also plays a role. Standard thicknesses for both the front pane and the pane facing the inner chamber, as well as any further panes, are from about 3 mm to about 5 mm, preferably from about 3 mm to about 4 mm.

To provide thermal insulation between the cold inner chamber and the warmer environment, the multipane insulating glass comprises two or more panes. Two panes are usually sufficient, but three panes may be useful.

The space or spaces between the panes is/are usually filled with air or, in order to provide further thermal insulation, with an inert gas, e.g. argon.

The transparent, electrically conductive coating may be positioned in each case on the inner side, i.e. the side which faces towards the space between the panes, of the pane which is closest to the inner chamber of the appliance or of the pane which is furthest away from the inner chamber, i.e. the front pane.

Condensation and precipitation of the condensate on the pane occurs if the temperature falls below the dew point.

This may take place on the front pane if, despite the insulation from the multipane insulating glass, the front pane is so cold on its outer side that the temperature falls below the dew point. Naturally, when this happens is dependent on the relative atmospheric humidity of the environment. Heating the pane allows the temperature of the pane to be kept above the dew point.

When the door is closed, the pane which is closest to the inner chamber is at a low temperature, which is dependent on the temperature of the inner chamber, on the side facing towards the inner chamber. Since the dew point lies at a lower temperature, the pane is free from fogging. However, when the door is opened, the temperature may fall below the dew point of the environment on its cold side, so that condensed atmospheric humidity is precipitated on the cold side of the door.

While the fogging described in the first instance can often be avoided, or at least reduced simply by providing an effective insulating glass arrangement, the latter case arises considerably more frequently.

Therefore, it is preferable for the pane which is closest to the inner chamber of the appliance to have the transparent, conductive coating on its side which faces towards the space between the panes, by means of which coating it is heated, usually to a temperature which is about 1° C. to 4° C. higher than without heating.

Although this often does not prevent fogging when the door is opened, it does accelerate the disappearance of the fogging after the door has been closed.

Since the power which is usually used means that the pane takes a relatively long time to heat up, or rapid heating requires a very high power, it can be preferable for the particular pane to be heated continuously in both variants described.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is to be explained in more detail with reference to the drawings, wherein.

DESCRIPTION OF THE PREFERRED EMBODIMENT

Figure 1:
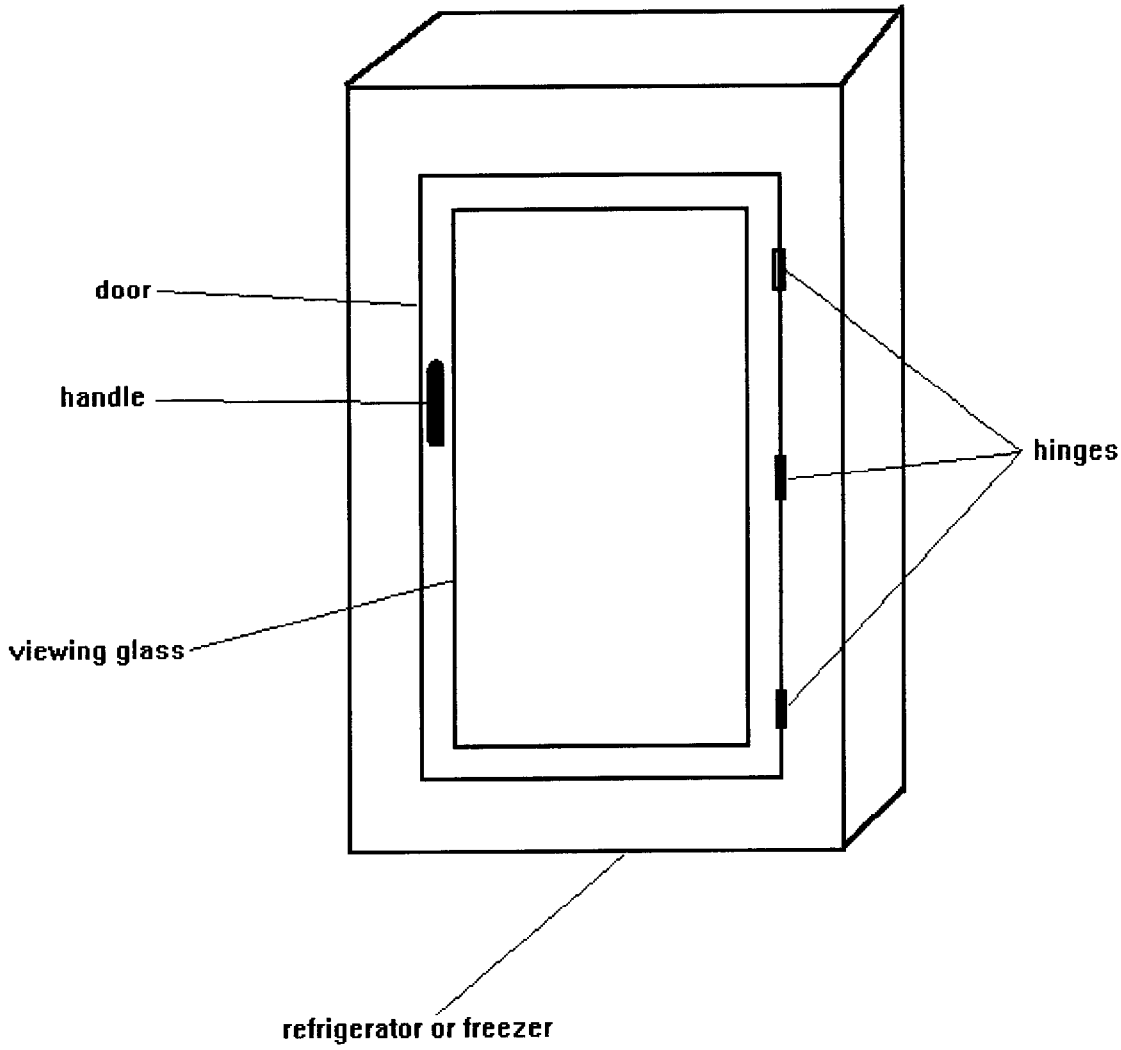
FIG. 1 shows a diagram of a refrigerator or freezer in which the present invention may be utilized.

FIG. 1 shows a refrigerator or freezer with a door with a transparent viewing area. The viewing area can be glass or some other transparent or translucent material.

Figure 2:
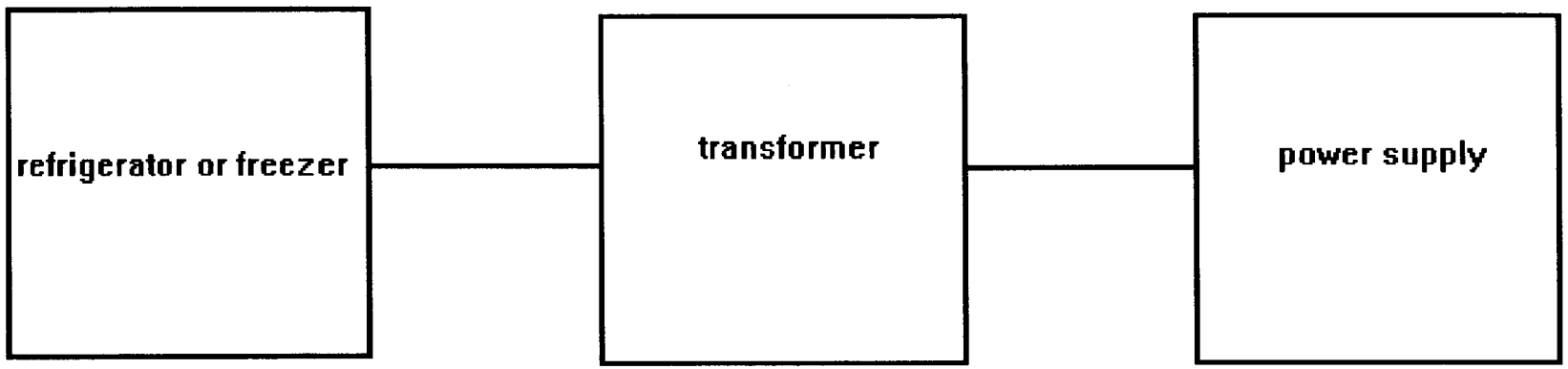
FIG. 2 shows a block diagram of a refrigerator or freezer with a transformer and a power supply of at least one embodiment of the present invention.

FIG. 2 shows a box diagram showing a refrigerator or freezer with a power supply and a transformer to convert the line voltage to the voltage used in at least one embodiment of the present invention.

Figure 3:
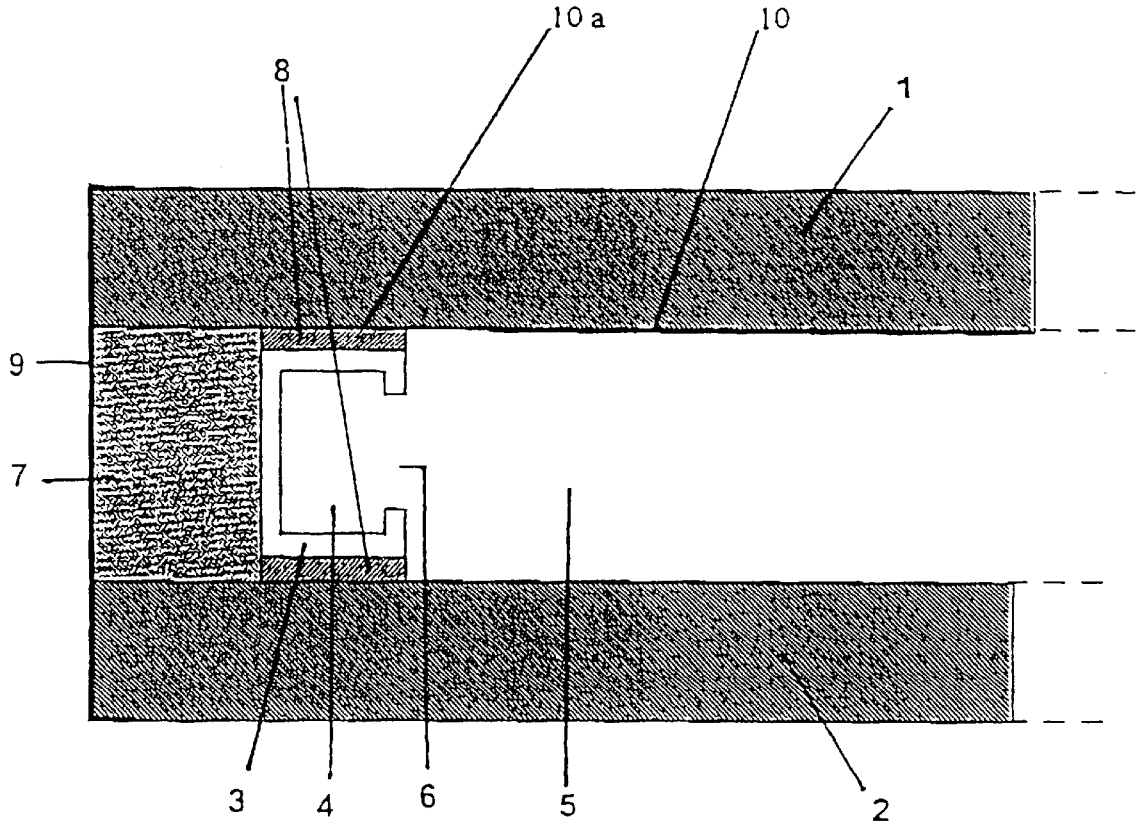
FIG. 3 shows, not to scale, part of a cross section through two-pane insulating glass of an appliance in which the temperature of the inner chamber is lower than the ambient temperature.

FIG. 3 shows part of a cross section through a two-pane insulating glass material used in an appliance in which the temperature of the inner chamber is lower than the ambient temperature. The appliance can be, for example, a refrigerator or cooler, or freezer. The two-pane insulating glass shown comprises the two transparent glass panes 1 and 2, which are held at the desired distance from one another by the spacer 3, which is preferably made from stainless steel. A granular drying agent can be located in the interior 4 of the hollow section. Gas exchange between the drying agent and the space 5 between the panes 1 and 2, which can be filled with argon, is ensured by means of the opening 6. The spacer 3 is set back about 3 mm from the edge of the panes, in order to form a gap for receiving the insulating and sealing compound 7, which is a polysulphide elastomer, e.g. THIOKOL, by means of which the panes 1 and 2 are adhesively bonded to one another and sealed with respect to the outside. The spacer is adhesively bonded to the two panes by means of the adhesive 8, made from polyisobutylenes. Both the adhesive 8 and the sealing compound 7 are electrical insulators. The adhesive tape 9 represents the edge enclosure and serves to protect the edges. Preferably, the edges are simply arrissed. There is no need for further machining of the edges. Glass pane 2 is the pane which is closer to the environment, i.e. the front pane. Glass pane 1 is closer to the inner chamber of the appliance (not shown). On its inner side, i.e. the side which faces towards the space between the panes, it is provided with a transparent, electrically conductive coating 10 of $SnO_2$:F, to which silver conductor tracks have been applied, by means of which the pane is heated. In the peripheral area 10*a*, which is composed of the contact surface for the sealing compound 7, the contact surface for the spacer 3 and a zone of about 2 mm beyond the latter spacer, and which constitutes about a 10 mm-wide zone which runs continuously around the edge, the coating is deactivated, i.e. made electrically non-conductive, by means of a glaze which has been applied as described in the example given below.

Figures 4A, 4B:
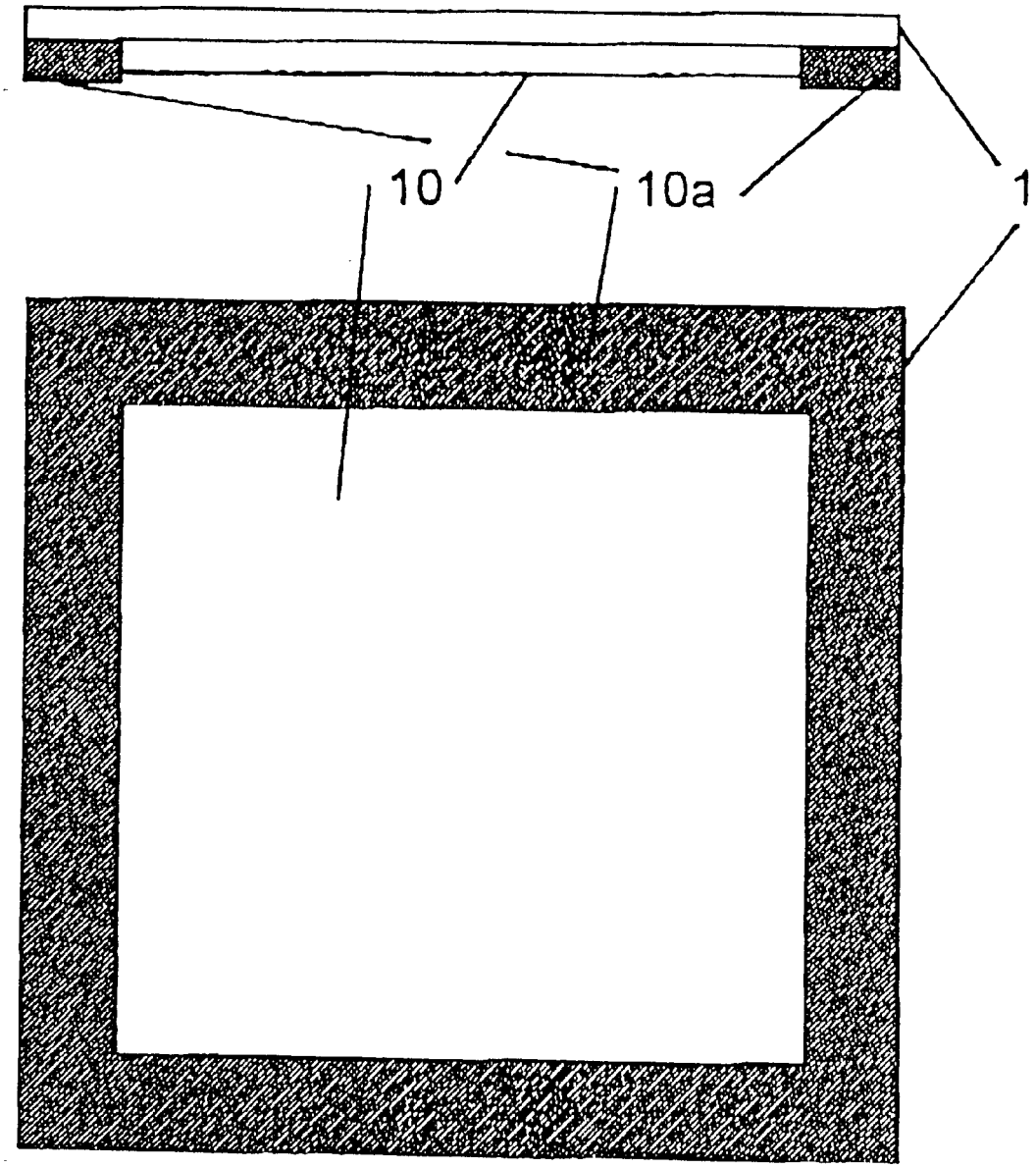
FIG. 4A shows a plan view.
FIG. 4B shows a cross section through a glass pane which is provided with a partially deactivated, conductive coating, both figures not being to scale.

FIG. 4A shows a plan view of a glass pane 1 as used, in multipane insulating glass according to the invention for an appliance in which the temperature of the inner chamber is lower than the ambient temperature, as the pane which is closer to the inner chamber of the appliance. On the side which, in the insulating glass module, faces towards the space between the panes, it has a transparent, electrically conductive coating 10 of $SnO_2$:F. In the continuous peripheral area 10*a*, it is deactivated, i.e. made electrically non-conductive, by the application of a glaze.

FIG. 4B shows a cross section through the individual glass pane 1. The coating 10 and the deactivated part in the peripheral area 10*a* are portrayed as larger than they really are.

EXAMPLE

The continuous peripheral area, which is about 10 mm wide, of a about 4 mm-thick pane in about a 600×800 mm format made from soda-lime glass with about a 5 mm thick coating of $SnO_2$:F on one side, which had a sheet resistance of 25 Ω/D (ohm per square), was treated, on the coated side, with a commercially available ceramic glaze based on lead-free inorganic glass frit using the screen-printing process. After the screen-printed glaze had dried, the pane was heated for about 6 min. at about 650° C., during which time, on the one hand, the glaze was fired in, and, on the other hand, the pane was thermally prestressed. During firing of the glaze, the $SnO_2$:F layer is neutralized or destroyed and its electrical conductivity is lost.

The present invention provides multipane insulating glass for appliances in which the temperature of the inner chamber is lower than the ambient temperature, which glass reduces fogging resulting from condensation or accelerates the disappearance of the fogging. Compared to the multipane insulating glass materials of the prior art, the glass of the invention is simple to produce, since the flat glass can be coated in large formats and over its entire surface, i.e. without having to apply masks or the like, and/or because it is possible to use commercially available coated flat glass, since the glass is only cut to size after the coating. It is economical in process engineering terms that, of the additional process step of deactivation, in particular of glazing, which is now required during production, the firing is carried out at the same time as the thermal prestressing.

One feature of the invention resides broadly in the multipane insulating glass for appliances having an inner-chamber temperature which is lower than the ambient temperature, in particular for viewing doors of refrigerators and freezers, which glass comprises at least two panes which are of approximately equal size and are arranged at a distance from one another, the distance being maintained by a spacer which runs continuously around the vicinity of the edge, and one of the two outer panes being provided with an electrically conductive, transparent coating on its side which faces towards the space between the panes, characterized in that the conductive coating, which is applied to the entire surface, is deactivated in the peripheral area of the pane, containing the contact surface for the spacer.

Another feature of the invention resides broadly in the multipane insulating glass characterized in that the transparent, electrically conductive coating is a hard coating.

Yet another feature of the invention resides broadly in the multipane insulating glass characterized in that the coating comprises $SnO_2$:F.

Still another feature of the invention resides broadly in the multipane insulating glass characterized in that the coating has been deactivated by the application and subsequent firing of a glaze.

A further feature of the invention resides broadly in the multipane insulating glass characterized in that the pane which is closest to the interior chamber of the appliance is provided with the electrically conductive coating.

Another feature of the invention resides broadly in the process for producing coated flat glass materials for the production of multipane insulating glass materials, characterized by the following process steps: application of an electrically conductive, transparent coating to the entire surface of a flat glass pane cutting the pane to size deactivation of the coating in the peripheral area of the pane, including the subsequent contact surface for the spacer.

Yet another feature of the invention resides broadly in the process characterized in that the deactivation is effected by application and subsequent firing of a glaze.

Still another feature of the invention resides broadly in the process characterized in that the pane is thermally prestressed at the same time as the firing.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

Examples of display refrigerators and/or display freezers may be found in the following U.S. Pat. No. 4,691,486, entitled "Glass Assembly for Refrigerator Doors and Method of Manufacture"; No. 5,778,689, entitled "System for Maintaining Refrigeration Doors Free of Frost and Condensation"; No. 5,552,581, entitled "Defrost Heater for Cooling Appliance"; No. No. 5,329,736, entitled "Door Construction for Vertical Refrigerator and Freezer Spaces"; No. 5,090,175, entitled "Freezer Apparatus"; No. 4,855,567, entitled "Frost COntrol System for High-Speed Horizontal Folding Doors"; No. 4,658,533, entitled "Multi-Windowpane Structure for Use in a Temperature Controlled Environment"; and No. 4,496,201, entitled "Closure Such as a Glass Door for a Refrigerator or Freezer."

The corresponding foreign patent publication applications, namely, Federal Republic of Germany Patent Application No. 198 44 046.4-45, filed on Sep. 25, 1998, having inventors Kurt Leutner, Dr. Sabine Melson, and Dr. Roland Leroux, and DE-OS 198 44 046.4-45 and DE-PS 198 44 046.4-45, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. An appliance such as a refrigerator or freezer having a lower internal temperature than the ambient temperature, said appliance comprising a transparent viewing door, said transparent viewing door comprising:

at least two panes;

each of said at least two panes having substantially equal height dimensions and substantially equal width dimensions;

a spacer;

said spacer being disposed between said at least two panes to separate said at least two panes from one another and to hold said at least two panes with respect to each other;

a coating disposed on one of said at least two panes to remove condensation from said at least two panes;

electrical connections to connect said coating to a power supply;

said coating being substantially transparent;

said coating being electrically conductive;

said coating being disposed on a side of said one of said at least two panes facing another of said at least two panes;

said coating being disposed on substantially all of said side of said one of said at least two panes;

said coated side of said coated pane comprising a peripheral area and a central area, said peripheral area being disposed about said central area; and said originally electrically conductive peripheral area coating comprising an area of destroyed electrically conductive coating having been destroyed to render said electrically conductive coating in said peripheral area non-conductive.

2. The appliance according to claim 1 wherein:

each of said at least two panes has an edge about said pane; and said spacer is disposed to continuously contact at least a portion of said peripheral area of said pane.

3. The appliance according to claim 2 wherein said coating is a hard coating.

4. The appliance according to claim 3 wherein said coating comprises $SnO_2$:F.

5. The appliance according to claim 4 wherein said destroyed coating of said peripheral area of said coated pane comprises one of (a) and (b):

(a) a glaze applied to said peripheral area and fired on said peripheral area to render said electrically conductive coating in said peripheral area non-conductive; and (b) a ground-off area of said electrically conductive coating in said peripheral area to render said electrically conductive coating in said peripheral area non-conductive.

6. The appliance according to claim 5 wherein said coated one of said at least two panes is nearer the interior of the appliance than said another of said at least two panes.

7. The appliance according to claim 6 comprising:

a sealed space between said at least two panes; and said sealed space between said at least two panes containing argon.

8. An appliance such as a refrigerator or freezer having a lower internal temperature than the ambient temperature, said appliance comprising a transparent viewing door, said transparent viewing door comprising:

at least one pane;

a structure;

said structure being disposed adjacent said at least one pane;

a coating disposed on said at least one pane to remove condensation from said at least one pane;

said coating being substantially transparent;

said coating being electrically conductive;

said coating being disposed on substantially all of a side of said one of said at least one pane;

said coated side of said at least one pane comprising a peripheral area and a central area, said peripheral area being disposed about said central area; and said originally electrically conductive peripheral area coating comprising an area of destroyed electrically conductive coating having been destroyed to render said electrically conductive coating in said peripheral area non-conductive.

9. The appliance according to claim 8 wherein said coating is a hard coating.

10. The appliance according to claim 9 wherein said coating comprises $SnO_2$:F.

11. The appliance according to claim 10 wherein said destroyed coating of said peripheral area of said coated side comprises one of (a) and (b):

(a) a glaze applied to said peripheral area and fired on said peripheral area to render said electrically conductive coating in said peripheral area non-conductive; and (b) a ground-off area of said electrically conductive coating in said peripheral area to render said electrically conductive coating in said peripheral area non-conductive.

12. The appliance according to claim 11 wherein said at least one pane comprises at least two panes.

13. The appliance according to claim 12 wherein said structure comprises a spacer to separate said at least two panes.

14. The appliance according to claim 13 wherein only one of said at least two panes is coated.

15. The appliance according to claim 14 wherein said coated one of said at least two panes is nearer the interior of the appliance than another of said at least two panes.

16. The appliance according to claim 15 comprising:

a sealed space between said at least two panes;

said sealed space between said at least two panes comprising argon disposed in said sealed space to insulate the appliance; and each of said at least two panes having substantially the same dimensions as the others of said at least two panes.

17. A method of making an appliance such as a refrigerator or freezer, the appliance having a lower internal temperature than the ambient temperature and a transparent viewing door, the transparent viewing door comprising: at least two panes, a spacer, the spacer being disposed between the at least two panes to separate the at least two panes from one another and to hold the at least two panes with respect to each other, the at least two panes having a peripheral area adjacent the spacer; said method comprising the steps of:

coating substantially all of a side of one of the at least two panes with an electrically conductive transparent coating;

destroying said electrically conductive transparent coating in the peripheral area of the pane to render the peripheral area of the pane non-conductive; and mounting the coated pane in the appliance.

18. The method according to claim 17 wherein said step of destroying said electrically conductive transparent coating in the peripheral area of the pane to render the peripheral area of the pane non-conductive comprises one of the steps of (a) and (b):

(a) grinding off said coating in the peripheral area of the pane to render the peripheral area of the pane non-conductive; and (b) applying a glaze to the peripheral area of the pane, and firing the glaze in the peripheral area of the pane into the coating to destroy the electrical conductivity of the coating in the peripheral area.

19. The method according to claim 18 wherein said step of firing the glaze in the peripheral area of the pane into the coating to destroy the electrical conductivity of the coating in the peripheral area simultaneously pre-stresses the pane of glass.

20. An appliance such as a refrigerator or freezer having a lower internal temperature than the ambient temperature and a transparent viewing door made by the method of claim 19.

* * * * *

UNITED STATES PATENT AND TRADEMARK OFFICE

CERTIFICATE OF CORRECTION

PATENT NO. : 6,268,594 B1
DATED : July 31, 2001
INVENTOR(S) : Kurt Leutner, Sabine Melson, Roland Leroux It is certified that error appears in the above-identified patent and that said Letters Patent is hereby corrected as shown below:

Column 2,
Line 36, after 'approx.', delete "10 106/□" and insert -- 10Ω/□ --.

Column 6,
Line 62, after 'of', delete "25Ω/D" and insert -- 25Ω/□ --.

Signed and Sealed this

Fifth Day of March, 2002

*Attest:*

*Attesting Officer*

JAMES E. ROGAN
*Director of the United States Patent and Trademark Office*